US005139599A

United States Patent [19]

Kummerer

[11] Patent Number: 5,139,599

[45] Date of Patent: Aug. 18, 1992

[54] METHOD FOR DECORATING ARTICLES HAVING A CONICAL SURFACE

[75] Inventor: Karl Kummerer, Schwanstetten, Fed. Rep. of Germany

[73] Assignee: Leonard Kurz GmbH & Co., Fed. Rep. of Germany

[21] Appl. No.: 582,248

[22] Filed: Sep. 14, 1990

[30] Foreign Application Priority Data

Sep. 22, 1989 [DE] Fed. Rep. of Germany ..... 3931556

[51] Int. Cl.[5] ..... B44C 1/00

[52] U.S. Cl. ..... 156/240; 156/233; 156/234; 156/238; 156/361

[58] Field of Search ..... 156/230, 233, 234, 238, 156/240, 351, 361, 366, 367, 540

[56] References Cited

U.S. PATENT DOCUMENTS

| | | | |
|---|---|---|---|
| 3,657,053 | 4/1972 | Warsager | 156/540 |
| 3,816,207 | 6/1974 | Robertson et al. | 156/238 |
| 4,175,993 | 11/1979 | Robertson | 156/234 |
| 4,194,944 | 3/1980 | Spätle | 156/540 |
| 4,409,063 | 10/1983 | Brown | 156/238 |

*Primary Examiner*—Robert A. Dawson

*Assistant Examiner*—David Reifsnyder

*Attorney, Agent, or Firm*—Louis E. Marn

[57] ABSTRACT

In the decoration of an article having a conical surface by means of a decoration applied from an embossing foil, the embossing foil strip is unwound from a supply roll and passed around a deflection roller to feed it in the proper orientation to an embossing station in which a decoration is transferred from the embossing foil on to the surface of the article. The deflection roller and the embossing foil supply roll perform a linear movement parallel to the axis of the deflection roller and at the same time a pivotal movement about a pivot axis which is normal to that roller axis. The deflection roller is continuously linearly displaced by a distance corresponding to the deviation between the linear configuration of the embossing foil strip and the arcuate configuration defined by the development of the conical surface of the article to be decorated. At the same time the deflection roller is continuously pivoted through an angle so that the linear configuration of the embossing foil strip is compensated for in relation to the respective curvature angle of the arcuate development of the surface of the article to be decorated.

1 Claim, 6 Drawing Sheets

METHOD FOR DECORATING ARTICLES HAVING A CONICAL SURFACE

BACKGROUND OF THE INVENTION

Production procedures nowadays often involve a requirement of applying decoration to an article, for example for information or aesthetic purposes. Such a decoration may be applied by the use of an embossing foil which initially carries the decoration and from which the decoration is transferred on to the appropriate surface of the article. However, difficulties may be encountered in regard to applying a decoration from an embossing foil to a conical or tapering surface of an article. In a method of decorating an article having a conical surface, and in an apparatus for carrying out that method, as is to be found in German published specification (DE-AS) No. 27 21 980, the embossing foil which is provided with a plurality of decorations thereon in succession is unwound from a supply roll and passed to an embossing station for receiving a respective article to be decorated. In the embossing station the decoration is transferred from the embossing foil on to the conical or tapering surface of the article to be decorated. The embossing foil is deflected around a deflection roller which is disposed at a displacement arrangement, upstream of the embossing station, as considered in the direction of forward feed movement of the embossing foil towards the embossing station. The deflection roller, together with the embossing foil supply roll, by means of the displacement arrangement, is caused to perform a movement which is directed parallel to the axis of the embossing roller in the embossing station, and at the same time a pivotal movement about a pivot axis which is normal to the longitudinal axis of the embossing roller. That procedure is concerned with applying decoration by means of an embossing foil to an article which is for example a television casing, on a surface thereof which is in the general configuration of a truncated pyramid. In order to apply the operating procedure to that specific purpose, the supply roll is displaceable axially and substantially parallel to the embossing roller of the embossing station. Between the supply roll and the embossing roller, before being applied to the appropriate surface of the article to be decorated, the embossing foil is passed over a roller which is displaceable substantially parallel to itself, for tensioning of the embossing foil, and mounted rotatably about a transverse axis extending normal to the surface to be decorated. As, in the case of an article in the form of a truncated pyramid, the surface to be decorated comprises a plurality of at least substantially flat surface portions, the deflection roller around which the embossing foil passes can be in the form of what is known as a dancer roller, that is to say a roller which is mounted to be freely movable, and which is automatically adapted with a stepwise action to the respective parameters governed by the embossing foil and the respective surface portion of the article to be decorated. The dancer roller is movable with the supply roll for the embossing foil, in that arrangement.

However the situation is different when dealing with an article having a conical surface in the form of a truncated cone. Such articles may be for example cans, pots or the like.

SUMMARY OF THE INVENTION

An object of the present invention is to provide a method of decorating articles having a conical surface by means of an embossing foil, which permits decoration to be applied to the surface in an accurate position in a simple fashion and within a relatively short cycle time.

Another object of the invention is to provide a method of applying decoration from an embossing foil to a conical surface of an article, involving a small number of operating movements which are rationally adapted to each other.

Still another object of the invention is to provide a method of applying decoration to a conical surface of an article, which affords versatility of use in terms of the articles involved.

Yet a further object of the present invention is to provide an apparatus for applying decoration to a conical surface of an article by means of an embossing foil, which is of a simple and rational design configuration involving properly interrelated movements to provide short operating cycle times.

In accordance with the invention, in a first aspect thereof, these and other objects are achieved by a method of decorating articles having a conical surface, with a decoration from an embossing foil. The embossing foil which bears a plurality of decorations in succession thereon is unwound from a supply roll and passed to an embossing station for receiving a respective article to be decorated. In the embossing station the decoration is transferred from the embossing foil on to the surface to be decorated. Upstream of the embossing station, as considered in the direction of forward feed movement of the embossing foil, at a displacement means, the embossing foil is deflected around a deflection roller which, jointly with the embossing foil supply roll, and by virtue of the displacement means, performs a movement which is directed parallel to the axis of the embossing roller of the embossing station and at the same time a pivotal movement about a pivot axis which is normal to its longitudinal axis. The deflection roller is continuously displaced linearly by a distance corresponding to the respective deviation between the linear configuration of the embossing foil and the arcuate configuration defined by the development of the conical surface to be decorated. The deflection roller is simultaneously pivoted continuously so that the linear configuration of the embossing foil is compensated for, in relation to the respective curvature angle of the arcuate development of the surface to be decorated.

The invention therefore involves both a continuous linear movement of the deflection roller in relation to the embossing station and also a continuous pivotal movement of the deflection roller in relation to the embossing station, with the two movements being suitably adapted to each other and the dimensions and conicity of the surface of the respective article to be decorated. The deflection roller and therewith the embossing foil supply roll accordingly perform positive movements which are precisely matched to each other in two degrees of freedom, that is to say linear displacement and a displacement through a pivot angle. The fact that the movements of the deflection roller and therewith the embossing foil supply roll are specifically controlled by the operating mechanism of the apparatus for carrying out the method means that the movements are better controlled than when a dancer roller is involved, and the method according to the invention is therefore relatively time-effective insofar as an article with a conical surface and more specifically a frustoconical surface can be very accurately decorated with a decoration from an embossing foil within a short operating cycle time. The method can be used for example in decorating tea or coffee pots or the like articles.

In accordance with the invention, in another aspect thereof, the foregoing and other objects are achieved by an apparatus for decorating articles having a conical surface with a decoration from an embossing foil, comprising a supply roll for the embossing foil which is provided with a plurality of decorations in succession thereon, and an embossing station for receiving a respective article to be decorated. The embossing station includes a holding means for the article, and an embossing roller. Disposed upstream of the embossing station in the forward feed direction of the embossing foil is a deflection roller for changing the direction of the embossing foil and operatively associated with the deflection roller a displacement means. Operation of the displacement means causes the deflection roller to be displaceable in a direction at least substantially parallel to the axis of the embossing roller and pivotable about a pivot axis which is perpendicular to its longitudinal axis. The deflection roller is mounted on a mounting means rotatably about its longitudinal axis, with the mounting means being connected to a displacement platform forming part of the displacement means, pivotably about the above-mentioned pivot axis. The displacement platform is arranged on a stationary base means for linear movement by means of a drive arrangement, while the mounting means for the deflection roller has a feeler or follower element which is slidably guided by a guide means on the stationary base means.

As will be seen in greater detail hereinafter by means of a specific embodiment therefore the deflection roller of the apparatus according to the present invention is mounted on a mounting member rotatably about its longitudinal axis. The mounting member is also designed to support the embossing foil supply roll. Accordingly movement of the mounting member not only involves movement of the deflection roller but a simultaneous movement of the embossing foil supply roll. As indicated above, the mounting member is pivotally connected to the displacement platform by means of a pivot axis which is so oriented in relation to the embossing station as to minimise the possibility of distortion of the embossing foil which is unwound from the supply roll, deflected at the deflection roller and then passed to the embossing station. The displacement platform is linearly movably disposed on the stationary base means, the arrangement being such that the linear mobility of the displacement platform and therewith the linear movement of the mounting member and the deflection roller mounted thereon serve to compensate for the linear configuration of the embossing foil, in relation to the arcuate configuration defined by the development of the surface to be decorated by the application of the decoration thereto from the embossing foil. By virtue of the design configuration of the mounting member for the deflection roller, with the feeler or follower element which is slidably guided by a guide means on the stationary base means, any linear movement of the displacement platform and therewith at the same time the mounting member and the follower element thereof, results in a relative movement in relation to the guide means on the stationary base means. As a result, any linear movement of the displacement platform simultaneously produces a pivotal movement of the mounting member and therewith the deflection roller about its pivot axis, which thus serves to provide the above-mentioned compensation effect for the embossing foil, in relation to the respective aperture angle or angle of curvature of the arcuate development of the surface to be decorated. Accordingly the deflection roller performs positively controlled movements which are precisely matched to the surface configuration to be decorated, in the two possible degrees of freedom in which the deflection roller is capable of movement, that is to say with a translatory movement in its longitudinal direction and a rotary movement about its pivot mounting axis.

In a preferred feature of the invention, the above-mentioned drive means for producing the linear movement of the deflection roller may include a disc which is adapted to be driven about its central axis and which is rotatably mounted on the base means and which has a groove of spiral configuration. An angle lever or bell crank lever mounted on the base portion has a first limb operatively associated with the spiral groove and a second limb pivotally connected at a connection location to a connecting element or link which is pivotally mounted to the displacement platform. For that purpose, the stationary base means carries a mounting spindle which projects at least approximately perpendicularly away therefrom and on which the bell crank lever is rotatably mounted at its junction between its first and second limbs. The drive means for the disc with its spiral groove is preferably a drive which can also be operable to drive the embossing roller of the embossing station and further components of the apparatus. Because the first limb of the bell crank lever engages into the spiral groove in the disc, a rotary movement of the disc about its central axis results in a movement of the limb of the bell crank lever which engages into the groove, in the radial direction of the disc, so that at the same time the second limb of the bell crank lever performs a corresponding pivotal movement about the mounting axis of rotation of the bell crank lever. As the second limb of the bell crank lever is pivotally connected to a connecting element which is pivotally mounted to the displacement platform, rotary movement of the disc, by virtue of the pivotal movement of the second limb of the bell crank lever, produces a linear movement of the displacement platform because the latter is linearly guided by the guide means on the stationary base means.

In another preferred feature of the invention, the above-mentioned connecting element connecting the bell crank lever to the displacement platform is variable in length. In that way it is possible for the positive movement of the deflection roller in the two degrees of freedom referred to above to be precisely adapted as desired to any respective article to be decorated, in respect of dimensions and conicity. The same purpose can be achieved if the distance between the connection between the connecting element and the bell crank lever, in relation to the mounting axis of rotation of the bell crank lever, is variable, and/or if the point of mounting of the connecting element to the displacement platform is variable.

In accordance with another preferred feature of the invention, the guide means on the stationary base means may have a cam element at which the follower element is slidably guided. The cam element will be oriented in a direction which differs from the direction of the linear movement of the displacement platform, so that a linear movement of the displacement platform results in a pivotal movement of the deflection roller mounting member, by virtue of the connection of the mounting member to the follower element, and thus a corresponding pivotal movement of the deflection roller in relation to the displacement platform.

In order to provide for a further improvement in the adaptation of the positively controlled movements of the deflection roller in the two degrees of freedom thereof, to the surface to be decorated, a preferred feature of the invention provides that the guide means is arranged displaceably or adjustably on the base means. That also makes it possible for the linear movement and the pivotal movement of the deflection roller to be adjusted in relation to the embossing station and thus the surface to be decorated, to correspond to the dimensions and conicity of the surface in order thereby to apply the decoration from an embossing foil to the article to be decorated, in the precisely correct position.

Further objects, features and advantages of the present invention will be apparent from the following description of a preferred embodiment of the method and apparatus of the invention.

DESCRIPTION OF THE PREFERRED EMBODIMENT

Figure 1:
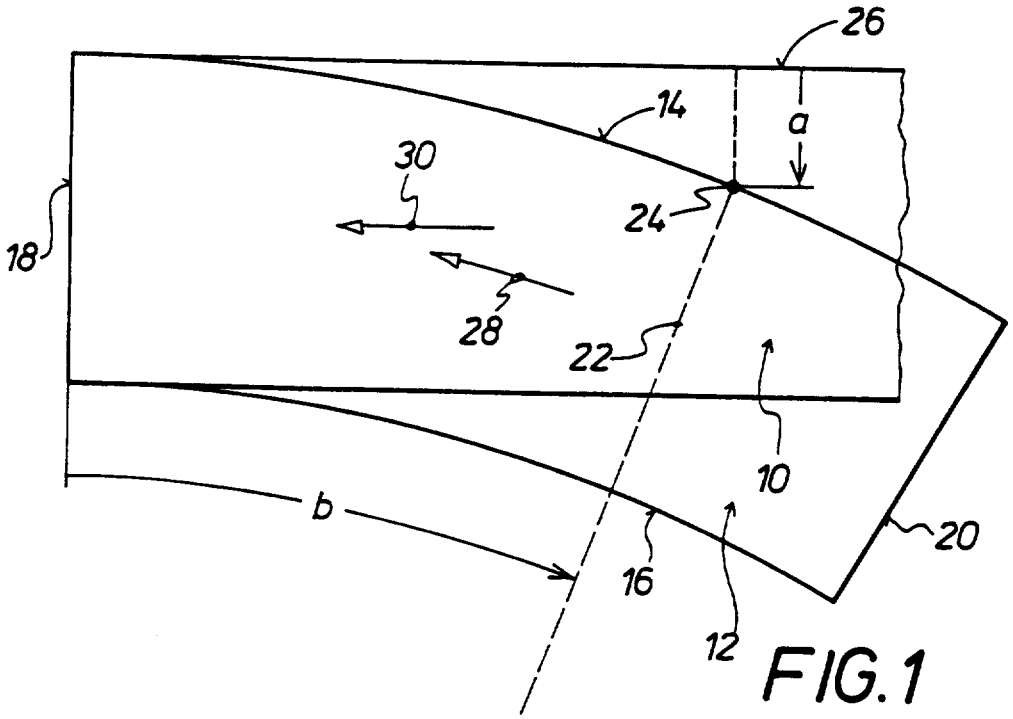
FIG. 1 is a view on a reduced scale of the development of a conical and more specifically a frustoconical surface of an article to be decorated, and a portion of an embossing foil carrying decorations.

Referring firstly to FIG. 1, shown therein is the conical, that is to say frustoconical surface of an article to be decorated, in the form of the development of that surface, in conjunction with a portion of an embossing foil from which decoration is to be transferred on to the surface to be decorated. FIG. 1 clearly shows the positively controlled movement which is to be performed by a deflection roller of the apparatus upstream of the embossing station as considered in the direction of forward feed movement of the embossing foil, in order to displace the embossing foil so that the embossing foil is precisely correctly matched to the surface to be decorated by a decoration transferred from the embossing foil.

Thus, FIG. 1 shows a portion of the embossing foil 10 which is of a linear strip-like configuration and which carries a plurality of decorations in succession thereon. Reference numeral 12 in FIG. 1 shows the development of the frustoconical surface of an article to be decorated by a decoration from the embossing foil 10. The development 12 of the surface to be decorated comprises an outside arc 14, an inside arc 16 and side edges 18 and 20. Reference numeral 22 in FIG. 1 denotes just any generatrix line of the development 12 of the surface to be decorated. The line 22 defines an angle b which can be referred to as an aperture angle or an angle of curvature, in relation to the first side edge 18 of the strip portion of embossing foil 10. Reference numeral 24 in FIG. 1 identifies the point of intersection between the line 22 and the outside arc 14 of the development 12 of the surface to be decorated, the point 24 being disposed at a spacing a from the adjacent edge 26 of the embossing foil 10 or the decoration thereon. There is a precisely defined relationship between the distance a and the angle b, that relationship being dependent on the dimensions and the conicity of the article to be decorated, and the development 12 thereof. Arrow 28 in FIG. 1 indicates the direction of rotation of the article to be decorated, that is to say the movement of the development 12 thereof, while arrow 30 indicates the simultaneous forward feed movement of the embossing foil 10 with the decoration thereon.

It will be clearly apparent from FIG. 1 that, as a result of the arcuate configuration of the development 12 of the surface to be decorated, the embossing foil 10, in order to adapt to the rotary movement of the frustoconical surface to be decorated thereby, must perform a linear movement in accordance with the respective distance a and at the same time a pivotal movement corresponding to the respective angle b associated with each value of the distance a, in order to ensure that the embossing foil 10 and the decoration thereon is accurately matched to the surface to be decorated. It will be seen therefore that the angle b will vary as the value of the distance a alters. The way in which the adaptation effect, as between the linear movement and the pivotal movement of the embossing foil 10, is achieved, will be described in greater detail hereinafter with reference to the diagrammatic view of the apparatus shown in FIG. 2 and the preferred construction of the apparatus as shown in FIGS. 3 through 7.

Figure 2:
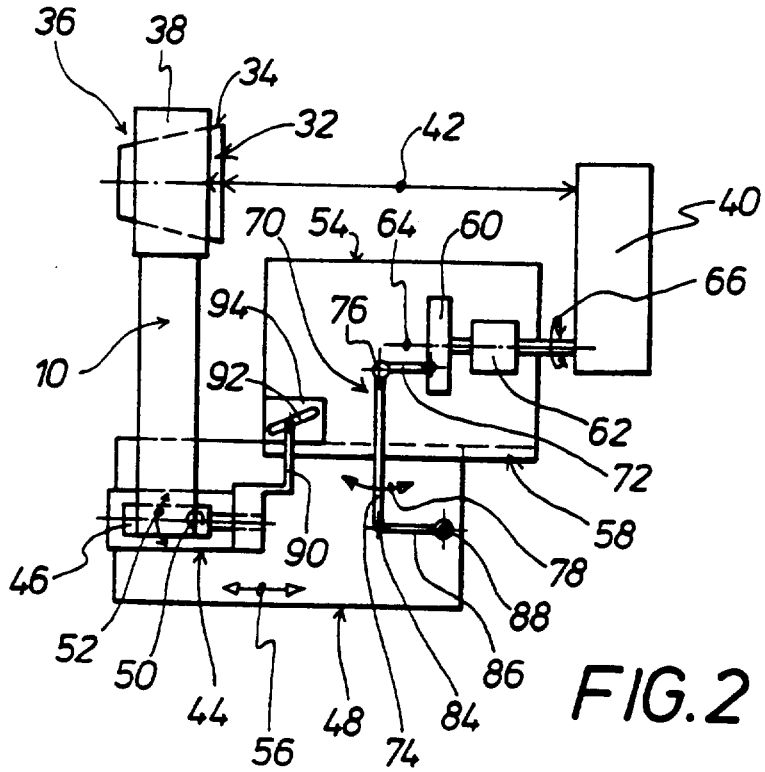
FIG. 2 is a diagrammatic plan view of an embodiment of the apparatus according to the invention, on a reduced scale.

Referring therefore now to FIG. 2, showing a plan view in diagrammatic form on a reduced scale of a form of the apparatus according to the invention, reference numeral 32 identifies an article to be decorated, which has an outside surface 34 of generally frustoconical configuration, which is to be decorated at a precise position thereon by means of a decoration from an embossing foil in strip form as indicated at 10. For that purpose the article 32 to be decorated is disposed at an embossing station 36 which is provided with an embossing roller 38. The article 32 and the embossing roller 38 are suitably connected to a drive arrangement as indicated at 40, with the drive connection therebetween diagrammatically indicated by reference numeral 42.

The embossing foil 10 is carried on a supply roll (not shown), with the embossing foil supply roll being rotatably mounted on a mounting member 44. A deflection roller 46 is also rotatably mounted on the mounting member 44. The embossing foil 10 is deflected or diverted around the deflection roller 46, in the vicinity of but upstream of the embossing station 36, as considered in the direction of forward feed movement of the embossing foil 10. The mounting member 44 is mounted on a displacement platform 48 pivotably about a pivot axis 50, with the pivotal movement being indicated by the double-headed arrow 52. The displacement platform 48 is linearly movably guided in relation to a stationary base portion 54 of the apparatus, the linear movement being indicated by the double-headed arrow 56. As the mounting member 44 is connected to the displacement platform 48 by means of the pivot axis 50, a linear movement of the displacement platform 48, as indicated by the arrow 56, produces a corresponding linear movement of the deflection roller 46 around which the embossing foil 10 passes before going into the embossing station 36.

So that the displacement platform 48 is capable of performing the linear movement indicated by the double-headed arrow 56, the stationary base portion 54 provides a linear guide arrangement indicated at 58. The drive for the displacement platform 48 is produced by means of a disc 60 which is mounted on the stationary base portion 54 by means of a mounting assembly 62, in such a way as to be rotatable about the central axis 64 of the disc 60, with such rotary movement being indicated in FIG. 2 by the double-headed arrow 66.

Figure 5:
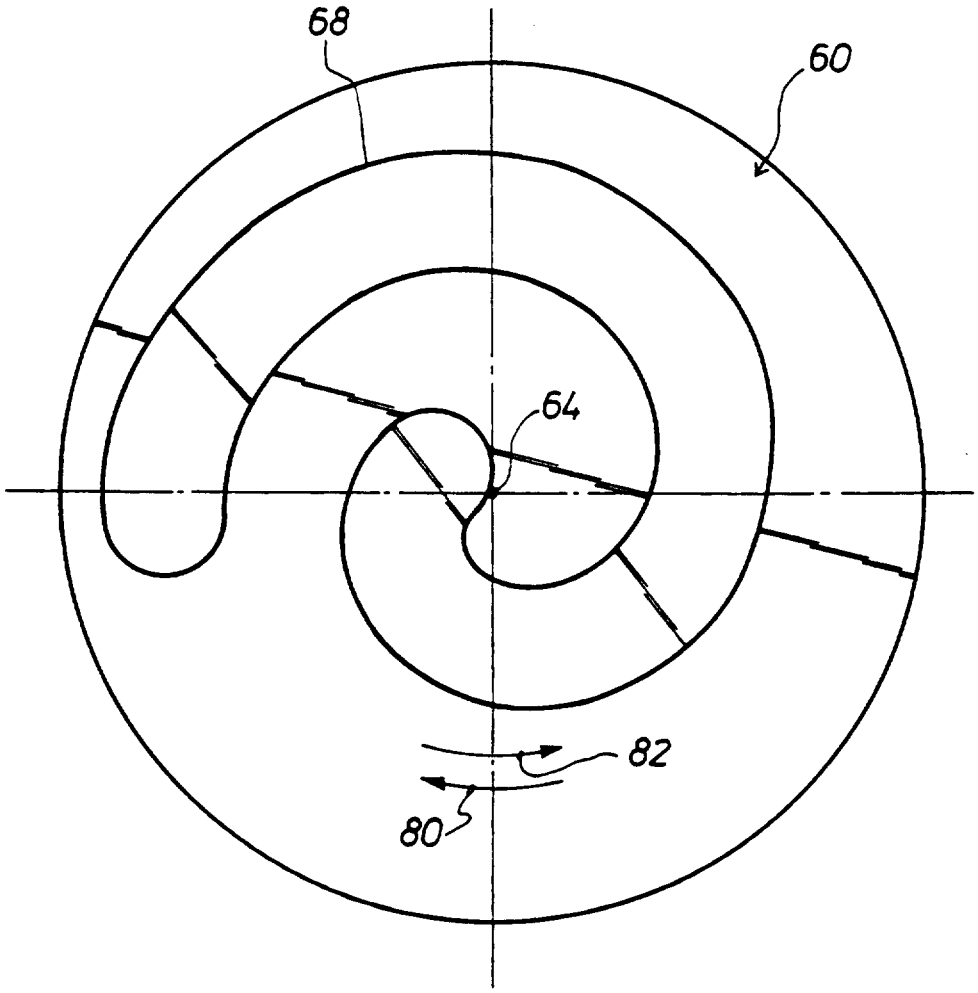
FIG. 5 is a view on to the face of a drive disc of the apparatus, with a spiral groove arranged therein.

Referring now to FIG. 5, it will be clearly seen therefrom that the face of the disc 60 is provided with a groove 68 of a spiral configuration. The apparatus shown in FIG. 2 includes an angle or bell crank lever 70 with first and second limbs 72 and 74. The limb 72 of the lever 70 engages into the groove 68 in the face of the disc 60. The lever 70 is mounted rotatably about a pivot axis 76 which projects away from the stationary base portion 54. The rotary movement of the lever 70 about the axis 76 is indicated by the double-headed arrows 78. The lever 70 thus performs a pivotal movement about its axis 76 by virtue of the limb 72 thereof engaging into the spiral groove 68 in the disc 60. Rotary movement of the disc 60 in the direction indicated by the arrow 80 in FIG. 5 produces a movement of the limb 72 of the lever 70 away from the central axis 64 of the disc 60 while conversely rotary movement of the disc 60 in the direction indicated by the arrow 82 in FIG. 5 produces a movement of the limb 72 of the lever 70 towards the central axis 64 of the disc 60. As a result the lever 70 performs corresponding pivotal movements about its axis 76, as indicated by the arrow 78.

The second limb 74 of the lever 70 has at least one connecting location 84 at which a connecting element or link 86 is pivotally connected to the limb 74. The second end portion of the connecting element or link 86, which is opposite the connecting location 84, is pivotally connected to the displacement platform 48 by means of a suitable mounting device 88. The mounting device 88 may be arranged on the displacement platform 48 in such a way that it can be varied in position thereon. By virtue of the linear guide arrangement 58, the displacement platform 48 performs a linear movement as indicated by the double-headed arrow 56, in relation to the stationary base portion 54, when the lever 70 performs the pivotal movement indicated by the double-headed arrow 78, as a result of rotary movement of the disc 60. It will be seen that the disc 60 is driven by the drive arrangement 40 which also drives the embossing roller 38.

Reference numeral 90 in FIG. 2 identifies a feeler or follower element 90 which projects away from the mounting member 44 carrying the deflection roller 46 and which is slidably guided in a cam element 92. The cam element 92 is provided on a guide device 94 carried on the base portion 54. The guide configuration of the cam element 92 is oriented in a direction which differs from the direction of linear movement of the displacement platform 48 so that a linear movement of the displacement platform 48 in the direction indicated by the double-headed arrow 56 and simultaneously therewith a linear movement of the mounting member 44 with the follower element 90 produces a pivotal movement of the mounting member 44 and therewith a corresponding pivotal movement of the deflection roller 46, as indicated by the double-headed arrow 52. The deflection roller 46 and the embossing foil supply roll which is also mounted on the mounting member 10 accordingly perform a precisely defined linear movement in the direction indicated by the double-headed arrow 56 and simultaneously therewith a pivotal movement about the pivot axis 50, which is precisely adapted to the linear movement. The relationship between the pivotal movement through the angle b and the linear movement over the distance a is clearly shown in FIG. 1.

Figure 3:
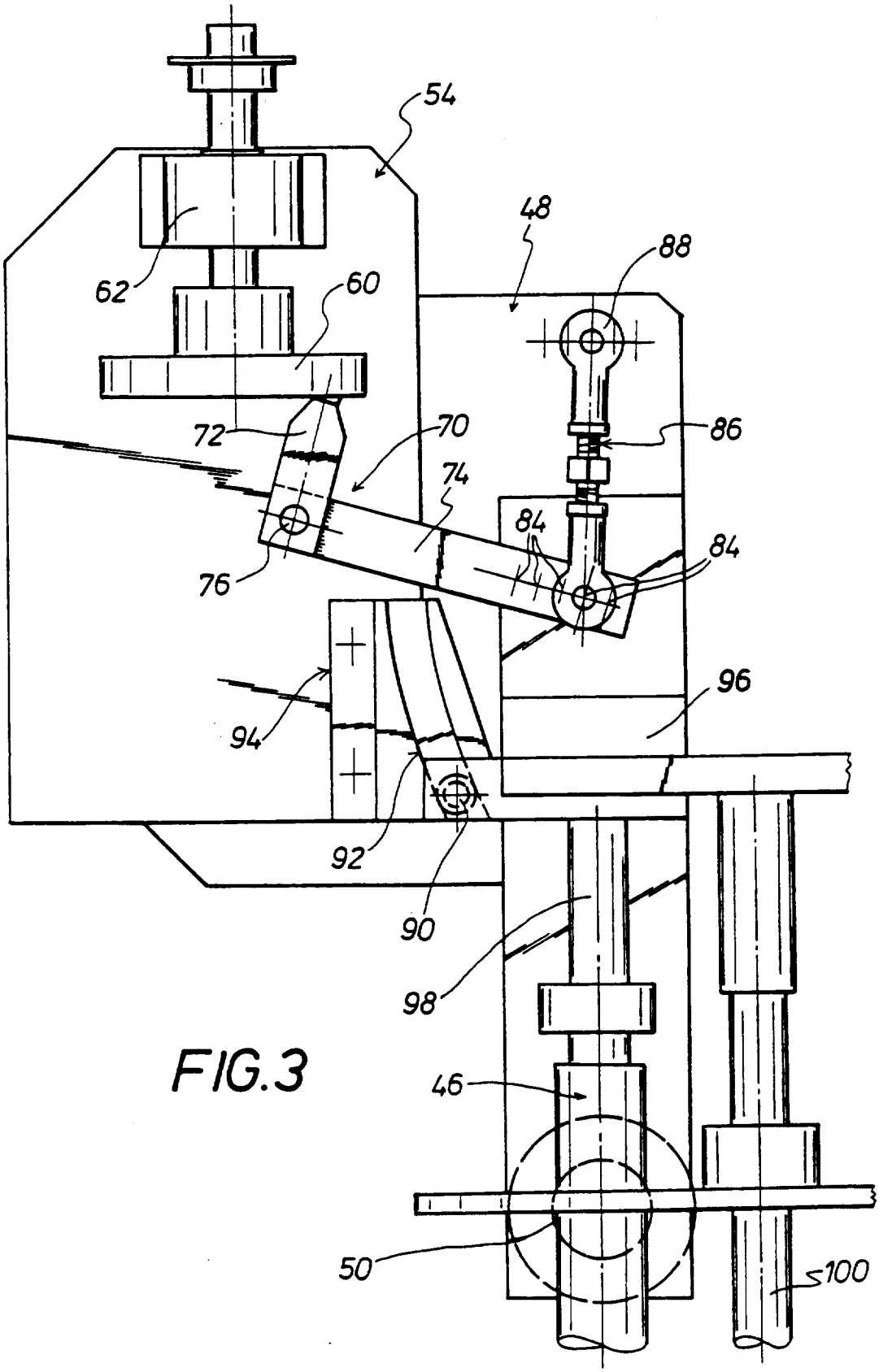
FIG. 3 is a plan view on another reduced scale of the preferred construction of the apparatus according to the invention.
Figure 4:
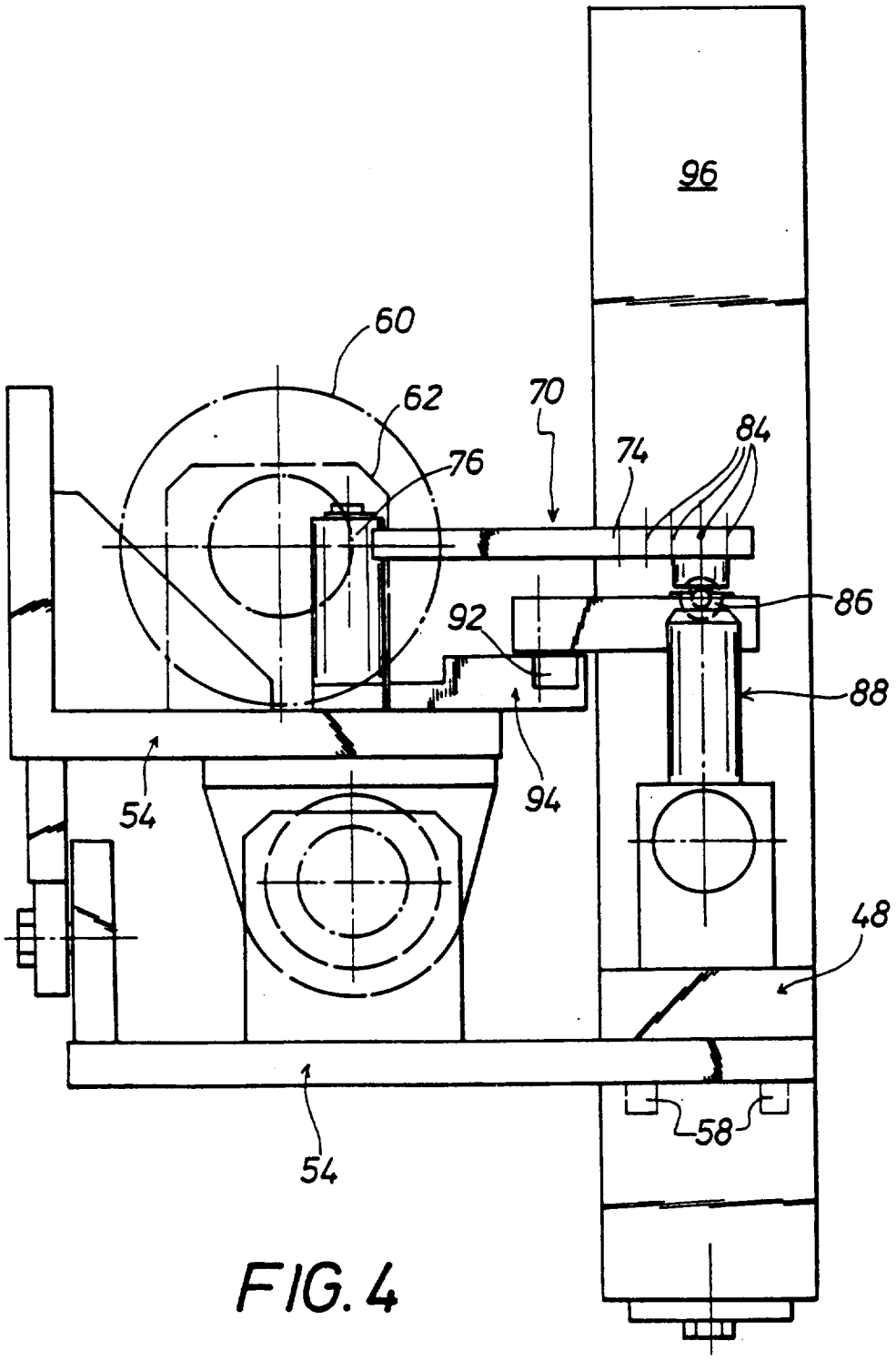
FIG. 4 is a front view of the apparatus shown in FIG. 3.

Reference will now be made to FIG. 3 and 4 which show a plan view and a front view of the major components of the desribed embodiment of the apparatus according to the invention, including the base portion 54 with the mounting arrangement 62 for the disc 60 which provides the spiral groove. The mounting axis 76 for the lever 70 projects away from the stationary base portion 54, as can be clearly seen from the view in FIG. 4.

As indicated above, the lever 70 is rotatable about the axis 76 and has its limb 72 engaging into the spiral groove in the disc 60 while the other limb 74 of the lever 70 has a number of connecting locations 84, disposed at spacings from each other. The connecting element 86 which is variable in length by the screwthread and nut configuration shown thereon in FIG. 3 is pivotally connected to one of the connecting locations 84. The connecting element 86 is pivotally connected to the mounting device 88 which projects from the displacement platform 48 in the same direction as the spindle or axis 76 for pivotally mounting the lever 70 projects away from the stationary base portion 54. The displacement platform 48 is linearly movably guided on the stationary base portion 54, the guidance effect being provided by means of a linear guide arrangement 58. The linear guide arrangement 58 comprises for example needle bearing means.

The displacement platform 48 is provided with a pillar element 96 which carries not only a shaft or spindle 98 for rotatably mounting the deflection roller 46 but also a supply roll 100 for the embossing foil 10. In addition, projecting away from the pillar element 96 on the displacement platform 48 is the follower element 90 which, as described above, engages into the cam element 92 of the guide arrangement 94 which is secured to the stationary base portion 54.

Figure 7:
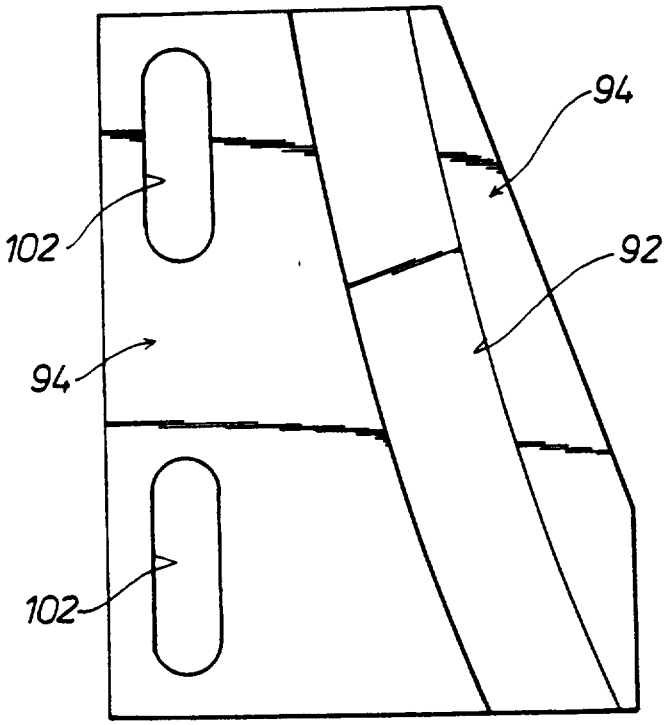
FIG. 7 is a view of a cam element of the apparatus, as shown in FIG. 3.

Reffering now to FIG. 7, it will be seen therefrom that the guide arrangement is provided with slots 102 so that it is possible for the guide arrangement 94 to be adjusted as desired in relation to the base portion 54 on which it is mounted. That affords the possibility of adapting the apparatus to articles to be decorated with different degrees of conicity. Reference numeral 92 in FIG. 7 also identifies the cam element in the form of a groove into which the follower element 90 on the displacement platform 48 engages and in which the follower element 90 is thus slidably guided.

Figure 6:
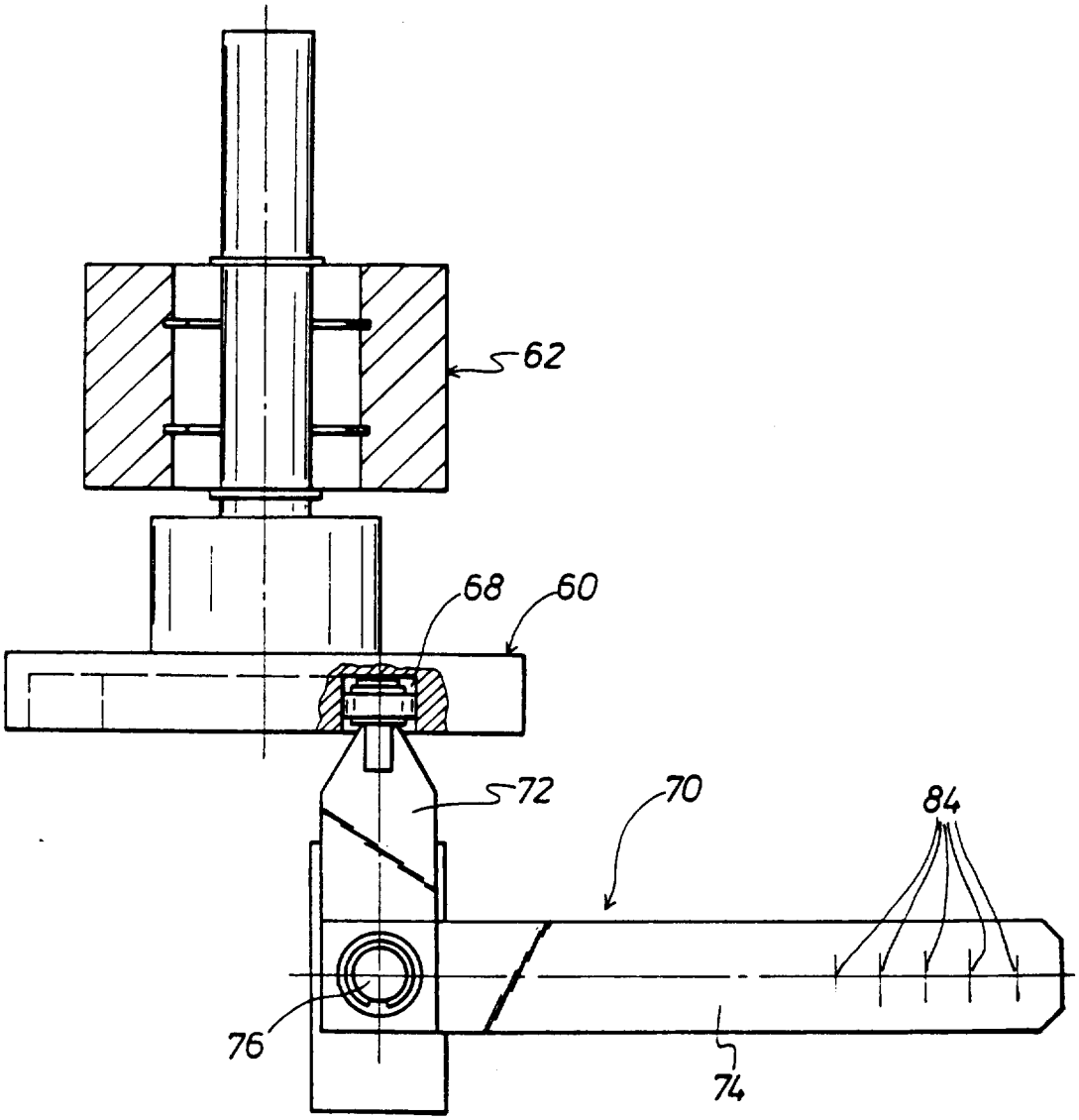
FIG. 6 shows a part of the FIG. 3 apparatus in order further to show the grooved disc and the bell crank lever co-operating therewith.

Referring now to FIG. 6, shown therein is a view of the disc 60 with the spiral groove therein, into which the lever 70 engages by means of its limb 72. Reference 76 in FIG. 6 again identifies the pivot mounting axis for the lever 70, the axis 76 being arranged on the base portion 54. The second limb 74 of the lever 70 is again shown in FIG. 6 as having a plurality of spaced-apart connecting locations 84 while reference numeral 62 in FIG. 6 again identifies the mounting arrangement for rotatably supporting the disc 60.

It will be appreciated that the above-described method and apparatus have been set forth solely by way of example and illustration of the principles of the present invention and that various modifications and alterations may be made therein without thereby departing from the spirit and scope of the invention.

I claim:

1. A method of decorating a surface of a conically-shaped article with a decoration from a supply roll of an embossing foil, which comprises the steps of:

a) positioning said conically-shaped article in an embossing station;

b) passing said embossing foil from said supply roll to said embossing station for transfer of said decoration onto said surface of said conically-shaped article;

c) coursing said embossing foil over a deflection roller prior to transfer of said decoration onto said conically-shaped article;

d) linearly displacing said supply roll and said deflection roller in parallel movement over a distance corresponding to respective deviation between linear configuration of said embossing foil and arcuate configuration defined by development of said surface of said conically-shaped article while simultaneously pivoting said supply roll and said deflection roller such that said linear configuration of said embossing foil is compensated in relation to respective aperture angle of said arcuate development of said surface of said conically-shaped article being decorated.

* * * * *